United States Patent [19]

Englund et al.

[11] Patent Number: 5,007,128

[45] Date of Patent: Apr. 16, 1991

[54] COMPOUNDING, GLAZING OR POLISHING PAD

[75] Inventors: Richard L. Englund; Thomas W. Schwartz, both of St. Paul, Minn.

[73] Assignee: Minnesota Mining and Manufacturing Company, St. Paul, Minn.

[21] Appl. No.: 458,411

[22] Filed: Dec. 28, 1989

Related U.S. Application Data

[63] Continuation-in-part of Ser. No. 298,508, Jan. 18, 1989, Pat. No. 4,962,562.

[51] Int. Cl.[5] ..... B24B 29/00

[52] U.S. Cl. ..... 15/230.16; 15/230; 15/230.18; 15/244.4; 51/394; 51/398; 51/401

[58] Field of Search ..... 15/230, 230.1, 230.14, 15/230.16, 230.17, 230.18, 244.4; 51/394, 395, 398, 401; 427/429

[56] References Cited

U.S. PATENT DOCUMENTS

| | | | |
|---|---|---|---|
| 1,953,983 | 4/1934 | Benner | 51/280 |
| 3,346,904 | 10/1967 | Armstrong | 15/230 |
| 3,418,675 | 12/1968 | Meguiar et al. | 15/230 |
| 4,609,581 | 9/1986 | Ott | 428/100 |

FOREIGN PATENT DOCUMENTS

| | | |
|---|---|---|
| 1254735 | 1/1961 | France . |
| 990142 | 4/1965 | United Kingdom . |

*Primary Examiner*—Edward L. Roberts

*Attorney, Agent, or Firm*—Gary L. Griswold; Walter N. Kirn; William L. Huebsch

[57] ABSTRACT

A paint finishing pad adapted to be used on a drive assembly including a back up pad and a drive motor for rotating the back up pad. The paint finishing pad includes a layer of open cell polymeric foam having a front surface defined by a plurality of spaced projecting portions of the layer of foam, and loops projecting from a rear surface of the layer of foam for releasably attaching the paint finishing pad to a support surface on the back up pad.

50 Claims, 2 Drawing Sheets

Fig. 1
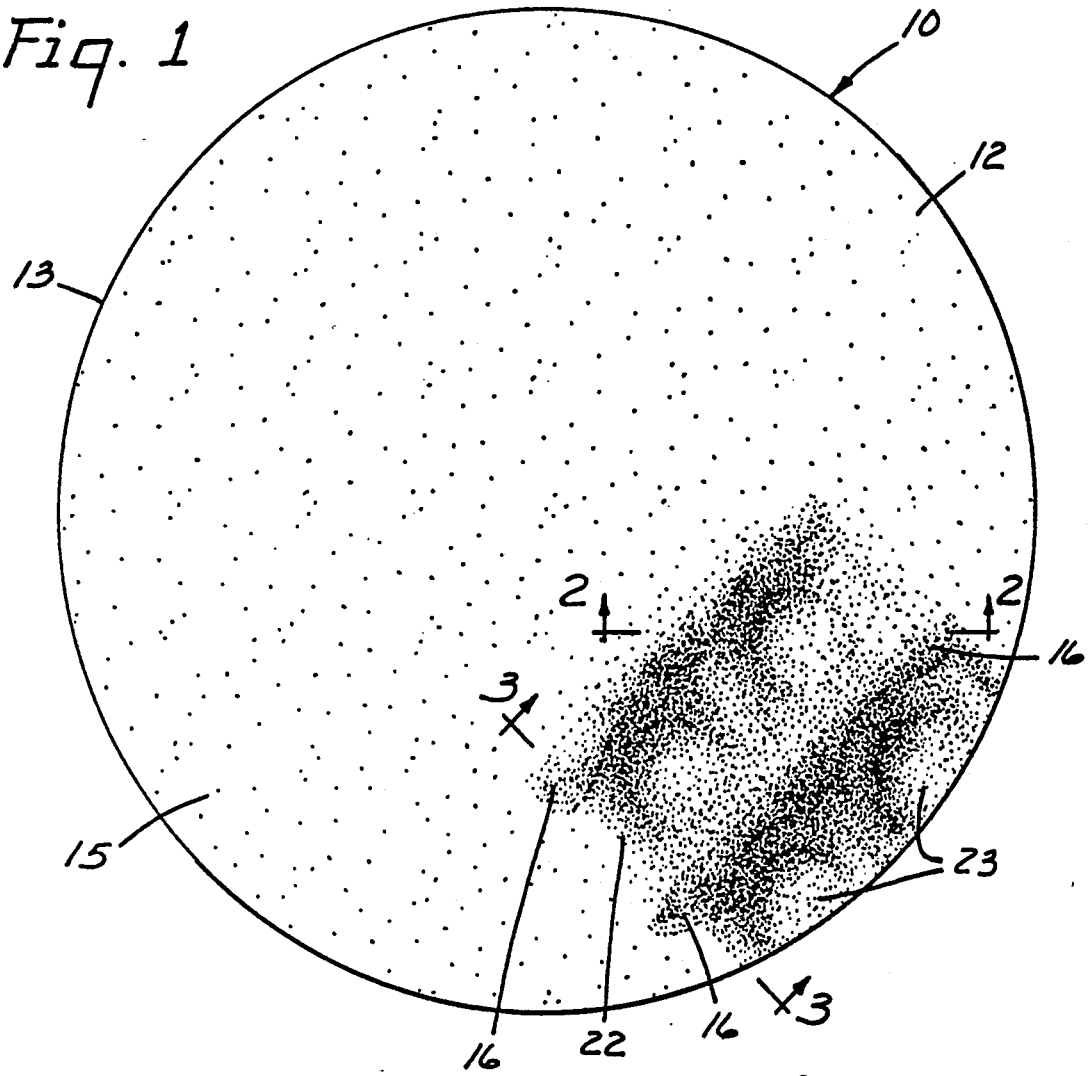
Fig. 2
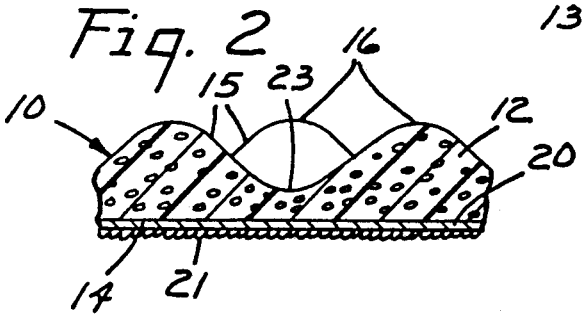
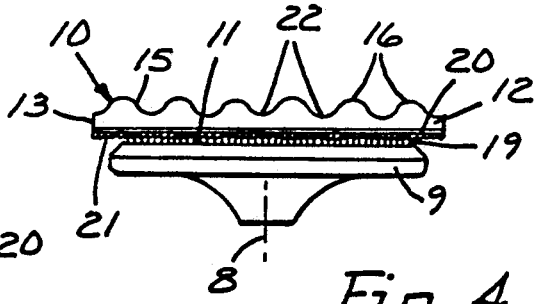
Fig. 4
Fig. 3
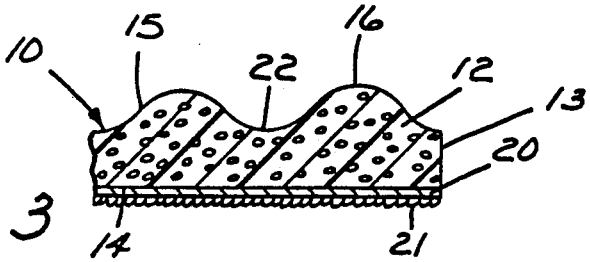

Fig. 5
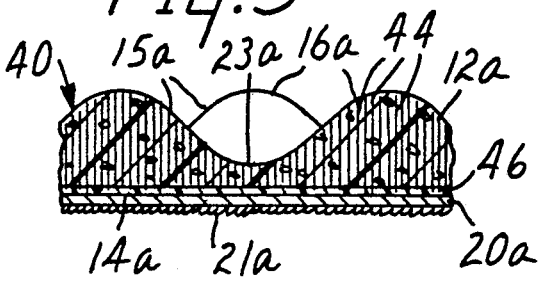
Fig. 6
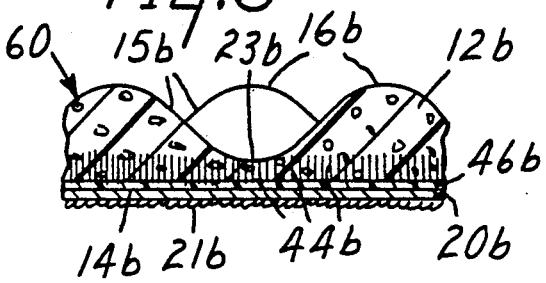
Fig. 7
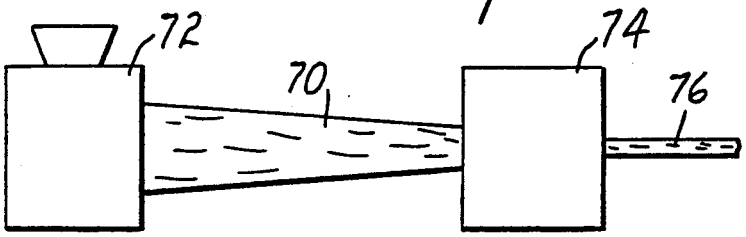
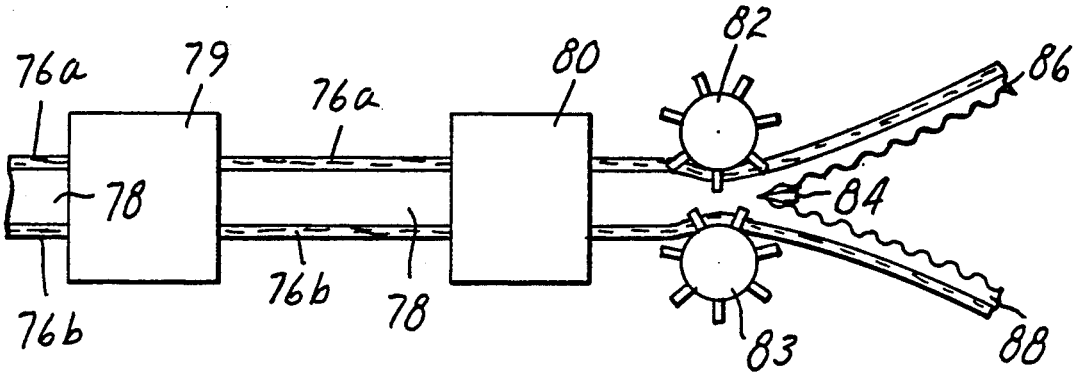
Fig. 8
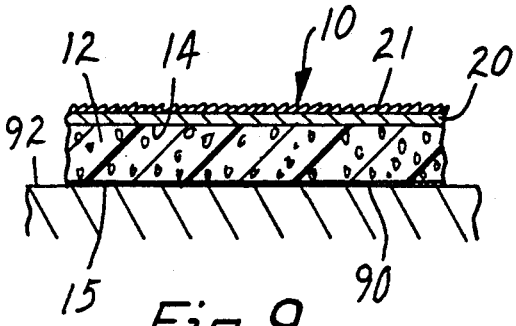
Fig. 9
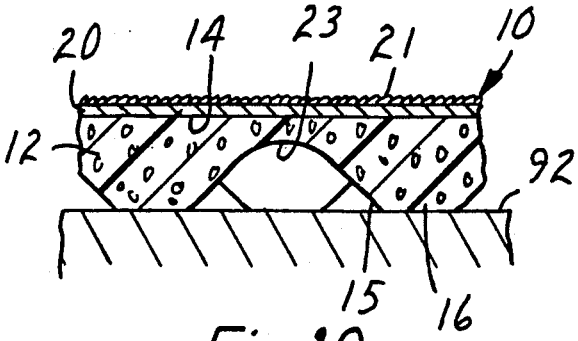
Fig. 10

COMPOUNDING, GLAZING OR POLISHING PAD

RELATED APPLICATION

This application is a continuation-in-part of U.S. patent application No. 298,508 filed Jan. 18, 1989, now U.S. Pat. No. 4,962,562.

TECHNICAL FIELD

The present invention relates to pads used to finish the exposed surface of paint such as on automobiles.

BACKGROUND ART

Finishing the exposed surface of new paint such as on an automobile, (particularly paint of the type called BC/CC (basecoat/clearcoat) which is a two-part paint system and is commonly used in after market painting of automobiles but also including other types of paint), typically includes (1) initial color sanding which is done by hand using fine grit abrasive (e.g., 1200 to 1500 grit) that provides substantial smoothing or leveling of the paint surface but results in surface scratches from the abrasive grit; (2) one or more intermediate compounding operations in which a liquid or paste rubbing compound containing a finer abrasive is applied by a machine rotated compounding pad having tufts of all wool or a wool and synthetic fiber blend to remove the scratches that result from the color sanding operation, which compounding operation leaves swirl marks on the paint; (3) a machine glazing operation in which a glaze including a yet finer abrasive is applied using a glazing or polishing pad to remove the swirl marks, which machine glazing operation leaves wheel marks that are particularly noticeable on dark color paints; and (4) a final hand glazing operation in which a glaze including an even finer abrasive is applied by hand in an attempt to remove the wheel marks. Often, the hand glazing operation fills some of the wheel marks rather than removing them, so that after a short period of time or when the paint is subsequently washed, the fill in the wheel marks is removed and the wheel marks can again be seen.

One type of pad commonly used for the machine glazing operation has tufts of a finer wool or wool blend than the compounding pad described above, while another type of pad used for the machine glazing operation is a foam pad (see U.S. Pat. No. 3,418,675) comprising a layer of open cell polymeric foam (e.g., two pound polyester urethane 5 centimeters (2 inches) thick and 15 or 20 centimeters (6 or 8 inches) in diameter) having a planar front surface by which the glaze is applied, and means for attaching a rear surface of the pad to a support surface on a back up pad of a drive unit, which, in at least one known foam pad, releasably attaches to the back up pad to facilitate changing foam pads. While such foam pads can be machine driven and used with commercially available glazes normally used for the hand glazing process (particularly including the glaze commercially identified as "IMPERIAL" machine glaze available from Minnesota Mining and Manufacturing Company (3M), St. Paul, Minn.) to remove wheel marks on test panels coated with type indicated above instead of using the hand glazing operation, such use of such foam pads presents several problems, including long working time apparently because of the low absorbency of the foam pads. Also, such foam pads have a tendency to sling glaze onto an adjacent area which may already have been finished. Build up of dried glaze on the surface of the foam pad can be deposited on the paint surface, resulting in a smear on that surface; and when the painted surface is almost dry and the final gloss is near, such foam pads have a tendency to grab the paint surface which causes vibration or chatter and operator fatigue.

DISCLOSURE OF INVENTION

The present invention provides a new foam pad for finishing the exposed surface of paint that can be machine driven and used with commercially available glazes normally used for the hand glazing process to remove wheel marks from the paint being finished instead of using the hand glazing operation, which new foam paint finishing pad, when compared to the foam pad described above, reduces slinging and working time, and greatly restricts smearing and the tendency of the new paint finishing pad to grab or chatter on the paint surface; which new foam pad may also be adapted to efficiently apply rubbing compound.

According to the present invention there is provided a finishing pad adapted to be used on a drive assembly including a back up pad having a generally planar support surface and a drive motor for moving the back up pad in a plane parallel to said support surface while using the pad to apply glazing or compounding material to a painted surface and thereby remove imperfections along and polish the painted surface. The paint finishing pad comprises a lofty, low density, resiliently compressible layer having a multiplicity of open sided pores formed by short elongate randomly disposed fibers joined to other fibers at their ends, such as a layer of open cell reticulated polymeric foam in which the fibers are joined by being integral with the other fibers to which they are joined, but which could also be a layer of a randomly woven fabric in which the fibers are joined to form the pores by being fused or adhesively bonded together. The resiliently compressible layer comprises a plurality of spaced projecting portions projecting a first distance at a right angle from a generally planar rear surface of the layer, and a plurality of recessed portions between the projecting portions and projecting a second distance at a right angle from its rear surface, which second distance is significantly less than the first distance (i.e., preferably the difference between the first distance and the second distance is more than about 0.64 centimeter (0.25 inch). The projecting and recessed portions at least partially define a front surface for the resiliently compressible layer opposite its rear surface; means are provided for releasably attaching the rear surface of the resiliently compressible layer to the support surface of the drive unit; and the layer is sufficiently resiliently flexible to afford manually pressing the resiliently compressible layer against the painted surface with a force sufficient to compress the portions of the resiliently compressible layer toward its rear surface and cause the parts of the front surface of the resiliently compressible layer defined by the projecting portions and at least some of the recessed portions to generally conform to the painted surface and press the glazing or compounding material aggressively into engagement with the painted surface for efficient removal of imperfections, and subsequently to press the resiliently compressible layer against the painted surface with a lesser force sufficient to only compress parts of the projecting portions of the pad to complete polishing of the painted surface.

It is theorized that the efficient removal of imperfections afforded by the finishing pad when the projecting and recessed portions are compressed may be facilitated by the different densities of the foam and/or the different pressures applied along the front surface of the layer to the painted surface due to the different amounts of compression of the projecting and recessed portions of the layer; and that the the efficient vibration and chatter free polishing afforded by finishing pad when only the projecting portions are in contact with the painted surface is facilitated by the relatively small area of contact between the layer and the painted surface, and the small change in pressure that results between the projecting portions on opposite sides of the layer and the painted surface when the rear surface moves slightly out of parallel with the painted surface as will frequently occur during polishing of the painted surface due to contours of the painted surface or positioning of the back up pad by the operator.

In a presently preferred embodiment for use in applying glazing material to a painted surface, the resiliently compressible layer is of a 1.75 pound per cubic foot polyester urethane reticulated open cell (or open pore) foam which has about 80 pores per linear inch, will be compressed by 25 percent by a pressure of 0.40 pounds per square inch, will be compressed by 65 percent by a pressure of 0.65 pounds per square inch, and is commercially available from Illbruck, Minneapolis, Minn. under the trade designation Standard Convoluted "SCOTFOAM" P-80 SIF; whereas in a presently preferred embodiment for use in applying compounding material to a painted surface, the resiliently compressible layer is of a slightly courser 1.7 pound per cubic foot polyester urethane reticulated open cell (or open pore) foam which has about 50 pores per linear inch, will be compressed by 25 percent by a pressure of 0.70 pounds per square inch, will be compressed by 65 percent by a pressure of 1.10 pounds per square inch, and is commercially available from Illbruck under the trade designation Standard Convoluted "SCOTFOAM" P-50 SIF 11, which foam has been partially filled with absorbent or adsorbent fibers extending at a right angle to the rear surface of the pad and having ends disposed about flush with at least portions of the front surface to increase the absorbency of at least portions of the pad.

Using either of the above mentioned foams or other materials for the resiliently compressible layer, the projecting portions of the layer can be disposed in a regular rectangular or square array, the layer can include ridge portions extending between adjacent projecting portions and projecting a third distance at a right angle from the rear surface of the layer, which third distance is less than the first distance and greater than the second distance, and the recessed portions can define a rectangular array of sockets with each of the sockets being bounded by the ridges between four adjacent projecting portions.

A method for applying glazing or compounding material to a painted surface to remove imperfections along and polish the painted surface using the finishing pad comprises the steps of applying the glazing or compounding material to the painted surface (which can be done directly or by first applying the material to the front surface of the resiliently compressible layer); rapidly moving the front surface of the resiliently compressible layer over the painted surface with the material between the front surface of the layer and the painted surface; pressing the resiliently compressible layer against the painted surface during an initial portion of the rapidly moving step with a force sufficient to compress the portions of the layer toward its rear surface and cause the parts of the front surface of the layer defined by the projecting portions and at least some of the recessed portions of the layer to generally conform to the painted surface and press the material into engagement with the painted surface for efficient removal of imperfections; and subsequently pressing the resiliently compressible layer against the painted surface during a final portion of the rapidly moving step with a force sufficient to only compress parts of the projecting portions of the layer to complete polishing of the painted surface. The resiliency of the projecting portions of the layer thus allows them to be compressed to afford almost full engagement at a relatively high pressure between the front surface of the layer and the paint surface when that is desirable during initial stages of the compounding or glazing operations, and allows them to project and limit the amount and the pressure of the contact between the front surface and the paint surface when that is desirable during the latter or polishing stages of the compounding or glazing operations.

BRIEF DESCRIPTION OF DRAWING

The present invention will be further described with reference to the accompanying drawing wherein like reference numerals refer to like parts in the several views, and wherein:

FIG. 1 is a front view of a first embodiment of a finishing pad according to the present invention that is particularly adapted for applying glazing material to a painted surface to thereby removing imperfections along and polish the painted surface;

FIG. 2 is a fragmentary sectional view taken approximately along line 2—2 of FIG. 1;

FIG. 3 is a fragmentary sectional view taken approximately along line 3—3 of FIG. 1;

FIG. 4 is a reduced side view of a combination of a back up pad from a drive assembly and the paint finishing pad shown in FIG. 1;

FIGS. 5 and 6 are fragmentary sectional views similar to FIG. 2 of two alternative embodiments of finishing pads according to the present invention that are particularly adapted for applying compounding material to a painted surface;

FIGS. 7 and 8 illustrate sequential steps included in a method for manufacturing the finishing pads illustrated in FIGS. 5 and 6; and FIGS. 9 and 10 illustrate sequential steps included in a method using a finishing pad according to the present invention for applying compounding or glazing material to and polishing a surface.

DETAILED DESCRIPTION

Referring now to FIGS. 1 through 4 of the drawing, there is shown a paint finishing pad according to the present invention generally designated by the reference numeral 10.

The paint finishing pad 10 is adapted to be used on a rotary drive assembly including a generally planar circular support surface 11 on a back up pad 9 (e.g., preferably the back up pad available from Minnesota Mining and Manufacturing Company, St. Paul, Minn. (3M) under the trade designation "part no. 051131.05717 Backup Pad") rotatable by a motorized drive unit (e.g., a standard automotive type polisher adapted to rotate the back up pad 9 at a speed in the range of about 1200 to 3000 R.P.M. such as the single or variable speed electrically activated drive units available from Black and Decker Inc., Hunt Valley, Md., or the variable speed air pressure activated drive unit available from Chicago Pneumatic Tool Company, Utica, N.Y.) about a central axis 8 normal to the support surface 11.

The paint finishing pad 10 comprises a resiliently compressible layer 12 of open cell polymeric reticulated foam having a generally planar rear surface 14, and a circular periphery 13 of a slightly larger diameter than the support surface 11 (e.g., the circular periphery 13 being about 20 centimeters (8 inches) in diameter, and the support surface 11 being about 17 centimeters (6.75 inches)in diameter). The resiliently compressible layer 12 comprises a plurality of spaced projecting portions 16 projecting a first distance at a right angle from the rear surface 14, and a plurality of recessed portions 23 between the projecting portions 16 and projecting a second distance at a right angle from the rear surface 14, which second distance is significantly less than the first distance. The projecting and recessed portions 16 and 23 at least partially define a front surface 15 for the layer 12 of foam opposite the rear surface 14. Means attached to the rear surface 14 are provided for releasably attaching the paint finishing pad 10 to the support surface 11 of the back up pad 9, which means as illustrated is an attachment layer 20 of material adhered to the rear surface 14 of the layer 12 of foam as by a hot melt adhesive or by flame laminating and having a plurality of projecting loops 21 adapted to be releasably engaged by projecting hooks 19 along the support surface 11 of the back up pad 9. The attachment layer 20 is porous and preferably made in the manner described in U.S. Pat. No. 4,609,581 (the content whereof is incorporated herein by reference) for placing loops 14 in a carrier web 12 of a structure described in that patent. Attachment of the attachment layer 20 of material to the layer 12 of foam by a porous web (e.g., 50 percent open area) of hot melt adhesive (e.g., "SHARNET" 4200, available from Sharnet Corp., Ward Hill, Mass.) or by flame laminating has been found to provide passageways between the attachment layer 20 and layer 12 of foam that afford passage of liquid therebetween to facilitates cleaning of the paint finishing pad 10.

As illustrated, the layer 12 of foam is a commercially available foam of the type available from Illbruck under the trade designation Standard Convoluted "SCOTFOAM" P-80 SIF (a two pound reticulated open cell polyester urethane foam having 80 pores per lineal inch) in which foam, as illustrated, the projecting portions 16 are disposed in a regular rectangular or square array, the layer 12 includes ridge portions 22 extending between adjacent projecting portions 16 and projecting a third distance at a right angle from the rear surface 14, which third distance is less than said first distance and greater than said second distance (i.e., midway between), and the recessed portions 23 define a rectangular array of sockets with each of the sockets being bounded by the also recessed ridge portions 22 between four adjacent projecting portions 16. It is preferred that the difference between the first distance and the second distance is more than about 0.64 centimeter (0.25 inch), (i.e., that the projecting portions 16 of the layer 20 of foam project more than about 0.64 centimeter (0.25 inch) beyond the recessed portions 23).

In use, the motorized drive unit (not shown) rotates the back up pad 9 about its axis 8 and/or reciprocates the back up pad 9 so that the paint finishing pad 10 is moved in a plane parallel to the support surface 11 of the back up pad 9 and can be used to glaze or polish a surface. If it is desired to change the paint finishing pad 10 (e.g., because pores of the paint finishing pad 10 have become loaded with glaze) the paint finishing pad 10 can be stripped away from the support surface 11, and replaced with a fresh paint finishing pad.

FIG. 5 is a sectional view similar to FIG. 2 of a paint finishing pad 40 according to the present invention that is particularly adapted for apply rubbing compound to remove the scratches that result from the color sanding operation. Many parts of the finishing pad 40 are essentially the same as corresponding parts of the finishing pad 10 and have been labeled with the same reference numerals to which have been added the suffix "a". The paint finishing pad 40 includes a resiliently compressible layer **12*a* preferably of open cell polymeric reticulated foam having a generally planar rear surface 14*a*, spaced projecting portions 16*a*, recessed portions 23*a*, a front surface 15*a*, and means attached to the rear surface 14*a* in the form of an attachment layer 20*a* including loops 21*a* for releasably attaching the paint finishing pad 40 to the support surface 11 of the back up pad 9, the shape and characteristics of which are essentially the same as those described above for their counterparts in the finishing pad 10, except that the foam in the layer 12*a* is preferably more coarse than the foam in the layer 12 (e.g., the commercially available foam available from Illbruck under the trade designation Standard Convoluted "SCOTFOAM" P-50 SIF 11 (a two pound reticulated open cell polyester urethane foam having 50 pores per lineal inch). The paint finishing pad 40 primarily differs from the paint finishing pad 10 in that it includes a multiplicity of absorbent or adsorbent filaments 44 extending through the resiliently compressible layer at generally a right angle to the rear surface 14*a* of the resiliently compressible layer 12*a* from a bonded mat 46 of similar filaments disposed between the rear surface 14*a* and the attachment layer 20*a*, which filaments 44 have ends disposed about flush with the front surface 15*a* of the layer 12*a*. The use of absorbent hydrophilic rayon filaments 44 in the resiliently compressible layer 12*a* has been found to significantly increase the ability of the finishing pad 40 to apply rubbing compound to a painted surface compared to the same resiliently compressible layer 12*a* without the filaments 44. It is anticipated that hydrophilic filaments 44** having better fluid transfer or wicking properties than rayon (e.g., Orlon or those fibers commercially available from Eastman Kodak under the trade designation "Eastman 4HE") would also be useful and could provide advantages for certain purposes; and that adsorbent filaments (e.g., blown microfibers) or oleophilic filaments could also be combined with or substituted for the hydrophilic filaments and thereby also provide advantages for certain purposes.

FIG. 6 is a sectional view similar to FIGS. 2 and 5 of a paint finishing pad 60 according to the present invention that like the paint finishing pad 40 is particularly adapted for apply rubbing compound to remove the scratches that result from the color sanding operation. The parts of the finishing pad 60 are essentially the same as corresponding parts of the finishing pad 40 and have been labeled with the same reference numerals except that the suffix "a" has been changed to the suffix "b", or the suffix "b" has been added. The paint finishing pad 60 differs from the paint finishing pad 40 only in that the multiplicity of absorbent or adsorbent filaments **44*b*** extending through the resiliently compressible layer 12b at generally a right angle to the rear surface 14b of the layer 12b have ends disposed about flush with only the surfaces of the recessed portions 23b of the layer 12b (i.e., the filaments 44b do not extend from the mat 46b to the surfaces of the projecting portions 16b). It is anticipated that this structure of the finishing pad 60 will provide sufficient absorbent or adsorbent portions of the front surface 15b during the initial portion of the compounding process when the layer 12b is pressed against the painted surface with sufficient pressure that both the projecting portions 16b and at least some of the recessed portions 23b are conformed to the paint surface to efficiently rub the compounding material into the paint surface, and that the fibers 44b will hold some remaining buffing compound along the recessed portions 23b of the layer 12b that are not in contact with a painted surface being finished during latter stages of the compounding process when only the end parts of the projecting portions 16b are compressed against the painted surface to polish it so that that additional buffing compound can be applied to the painted surface by applying more pressure to further compress the projecting portions 16b and press the recessed portions 23b against the painted surface if that is desired to further compound a portion of the painted surface that was not previously satisfactorily compounded. It may be also be desirable, if more absorbency or adsorbency is desired along the front surface 15b during the initial portion of the compounding process, to make the filaments 44b slightly longer than illustrated so that their ends are disposed about flush with the surfaces of the recessed portions 23b and the ridge portions 22b of the layer 12b but do not extend to the front surface 15b along the projecting portions 16b.

Steps included in a method for making either the paint finishing pad 40 or the paint finishing pad 60 are schematically illustrated in FIGS. 7 and 8. A uniform lofty randomly woven layer 70 (FIG. 7) is formed from a blend of 50 percent 1.5 denier rayon fibers and 50 percent 4.0 denier thermoplastic sheathed sheath-core fibers (e.g., the polyester core, co-polyester sheath fibers commercially available from Hoechst Celanese, Charlotte, N.C.) using a Rando Webber machine 72. The layer is then needle tacked using a needle tacking machine 74 to form a needle tacked mat 76 that can be handled and that weighs about 4 ounces per square yard. Two portions 76a and 76b of the needle tacked mat 76 (FIG. 8) are then positioned along opposite side surfaces of a uniformly thick layer 78 of two pound reticulated open cell polyester urethane foam having 50 pores per lineal inch (which side surfaces will become the rear surfaces 14a or 14b of the layers 12a or 12b in the finishing pads 40 or 60) and fibers from the needle tacked mat portions 76a and 76b are needle tacked by a needle tacking device 79 into the layer 78 of foam from both of its side surfaces to a desired depth and to an extent that will place a large number of filaments 44a or 44b in the layer 78 of foam which but will not compress the layer 78 of foam. The mat portions 76a and 76b attached to the layer 78 of foam are then heated in an oven 80 heated to 300 degrees Fahrenheit for about 1 to 1 and ½ minutes to melt the thermoplastic sheath of the sheath core fibers after which the sheath material from those fibers will bond themselves and the rayon fibers together in the mat portions 76a and 76b and to the layer 78 of foam. The layer 78 of foam with the bonded mat portions 76a and 76b bonded thereto is then "convoluted" in a conventional known manner by passing it through the nip between a pair of rollers 82 and 83 having interdigitated projections to compress different portions of the layer 78 of foam toward its opposite side surfaces and then slitting the compressed layer 78 of foam with a blade 84 to produce two halves 86 and 88 of the layer 78 of foam each with projecting, recessed and ridge portions that will provide the projecting, recessed and ridge portions 15a or 15b, 23a or 23b and 22a or 22b and the front surfaces 16a or 16b of the layers 20a or 20b in the paint finishing pads 40 and 60. Attachment layers 20a or 20b are then attached to the sides of the mat portions 76a or 76b opposite the convoluted foam by a suitable hot melt adhesive (not shown), and a plurality of the paint finishing pads 40 or 60 are die cut from the resulting laminates (also not shown).

Steps included in a method according to the present invention for applying glazing or compounding material 90 to a painted surface 92 to remove imperfections along and polish the painted surface 92 using any of the finishing pads 10, 40 or 60 are schematically illustrated in FIGS. 9 and 10 using the finishing pad 10. That method includes the steps of (1) applying the glazing or compounding material 90 to the painted surface 92 (which preferably is done directly, but which alternatively could be done by first applying the material 90 to the front surface 15 of the resiliently compressible layer 12); rapidly moving the front surface 15 of the resiliently compressible layer 12 over the painted surface 92 with the material 94 between the front surface 15 of the layer 12 and the painted surface 92 which can be done by attaching the finishing pad 10 to the back up pad 9 driven by a motorized drive unit, activating the motorized drive unit to rotate the back up pad 9, and manually moving the rotating back up pad 9 to move the front surface 15 of the layer 12 along the painted surface 92; pressing the resiliently compressible layer 12 against the painted surface 92 during an initial portion of the rapidly moving step as is illustrated in FIG. 9 with a force sufficient to compress the portions 16, 22, and 23 of the layer 12 toward its rear surface 14 and cause the parts of the front surface 15 of the layer 12 defined by the projecting, ridge and recessed portions 16, 22 and 23 of the layer 12 to generally conform to the painted surface 92 and press the material 90 into engagement with the painted surface 92 for efficient removal of imperfections; and subsequently, as is illustrated in FIG. 10, pressing the resiliently compressible layer 12 against the painted surface 92 during a final portion of the rapidly moving step with a force sufficient to only compress parts of the projecting portions 16 of the layer 12 to complete polishing of the painted surface 92. The resiliency of the projecting portions 16 of the layer 12 thus allows them to be compressed to afford almost full engagement at a relatively high pressure between the front surface 15 of the layer 12 and the paint surface 92 when that is desirable during initial stages of the compounding or glazing operations as is illustrated in FIG. 9, and allows them to project and limit the amount and the pressure of the contact between the front surface 15 and the paint surface 92 when that is desirable during the latter or polishing stages of the compounding or glazing operations as is illustrated in FIG. 10.

Test Results

The following test was run to determine the effect of different size recesses in a paint finishing pad 10 of the type described above. Six test panels were first painted with black BC/CC paint of the type described above and then were sequentially hand sanded with "MICRO-FINE 1500" abrasive paper (available from 3M), compounded using "IMPERIAL" microfinish compound (available from 3M) applied with a part no 5701 double sided "SUPERBUFF" compounding pad (available from 3M), and glazed with "FINESSE-IT II" glazing compound (available from 3M) applied with a part no. 5705 "SUPERBUFF" glazing pad (available from 3M). Different ones of the panels were then again glazed with "IMPERIAL" hand glaze (a glaze available from 3M that is normally applied by hand) using different paint finishing pads 10 of the type described above in which the projecting portions 16 of the layer 20 of foam projected different distances above the bottoms of the recessed portions 23 or sockets including 0.64, 1.3, 1.6, 1.9 and 2.2 centimeters ($\frac{1}{4}$, $\frac{1}{2}$, $\frac{5}{8}$, $\frac{3}{4}$ and $\frac{7}{8}$ inches), all of which paint finishing pads 10 were about 20 centimeters (8 inches) in diameter, had thicknesses at the recessed portions 23 of about 0.64 centimeter ($\frac{1}{4}$ inch) and were made of Standard Convoluted "SCOTFOAM" P-80 SIF obtained from Illbruck, and using a pad 20 centimeters (8 inches) in diameter and 2.5 centimeters (1 inch) thick of the same foam but having a flat surface by which the glaze was applied. The paint finishing pad 10 on which the projecting portions 16 of the layer 20 of foam projected 0.64 centimeter ($\frac{1}{4}$ inch) above the bottoms of the sockets 23 required a working time of 1 minute 42 seconds, produced an excellent swirl free surface, but when the painted surface was almost dry and the final gloss was near, had a slight tendency to grab the paint surface and cause vibration or chatter. The paint finishing pads 10 on which the projecting portions 16 of the layer 20 of foam projected greater than 0.64 centimeter ($\frac{1}{4}$ inch) above the bottoms of the sockets 23 required shorter working times of about 1 minute 20 seconds, produced excellent swirl free surfaces which were almost as good as the surface produced by the foam in which the 10 projecting portions 16 of the layer 20 of foam projected 0.64 centimeter ($\frac{1}{4}$ inch) above the bottoms of the sockets 23, and had no tendency to grab the paint surface and cause vibration or chatter when the painted surface was almost dry and the final gloss was near. In contrast, the pad with the flat surface for applying the glaze required the longest working time of 2 minutes 5 seconds, could not remove all the swirls from the surface, and when the painted surface was almost dry and the final gloss was near, had a definite tendency to grab the paint surface and cause vibration or chatter.

Paint finishing pads have been tested that comprised resiliently compressible layers having the same shape as the resiliently compressible layer 12 of the paint finishing pad 10, but which compressible layers, (instead of foam), were made of lofty, low density, resiliently compressible random woven material having a multiplicity of open sided pores formed by short elongate randomly disposed fibers adhesively joined to other fibers at their ends; including the random woven polymeric materials sold by Minnesota Mining and Manufacturing Company, St. Paul, Minn., under the trade designation "BUFF PUFF, Regular", or "BUFF PUFF, Gentle" which are described in U.S. Pat. No. 3,537,121, the content whereof is incorporated herein by reference. At column 2, lines 35 of that U.S. Pat. No. 3,537,121 that random woven polymeric material is described as a lofty nonwoven mat formed essentially from tough strong resilient fibers bonded together at points where they cross and contact each other with a binder comprising a soft resin. Paint finishing pads in which the compressible layers have the shape described above and which are made using those random woven materials, when used to apply compounding materials to painted surfaces, have been found to compare favorably with paint finishing pads made with the foams described above without the absorbent or adsorbent filaments, (i.e., both providing 10 to 20 percent less cut and finish than conventional tufted wool pads normally used for that purpose) The addition of the absorbent filaments 44 to the compressible foam layer **12*a* in the pad 40 has significantly improved the cut and finish for compounding material applied using the pad 40 (although it is still not quite as good as a conventional tufted wool pad) and it is expected that similar improvements can be achieved by placing absorbent or adsorbent filaments in the compressible layers of random woven material in the same locations that the filaments 44 and 44*b* are placed in the layers 12*a* and 12*b* of the pads 40 and 60. It was found that the addition of the filaments 44 to the foam layer 12*a* in the pad 40 reduced working time when the pad to apply compounding material by up to 50 percent when compared to using the layer 12*a* without the filaments 44**, and allowed the compounding material to be applied using a D.A. (dual action) sander in a reasonable amount of time.

The present invention has now been described with reference to one embodiment and several variations thereof. It will be apparent to those skilled in the art that many changes can be made in the embodiment described without departing from the scope of the present invention. Thus the scope of the present invention should not be limited to the structure described in this application, but only by structures described by the language of the claims and the equivalents of those structures.

We claim:

1. A paint finishing pad adapted to be used on a drive assembly including a back up pad having a generally planar support surface and a drive motor for moving the back up pad in a plane parallel to said support surface while using the finishing pad to apply glazing or compounding material to a painted surface and thereby remove imperfections along the polish and painted surface, said finishing pad comprising:

a layer of resiliently compressible open cell polymeric foam having a generally planar rear surface, said layer comprising a plurality of spaced projecting portions projecting a first distance at a right angle from said rear surface, and a plurality of recessed portions between said projecting portions and projecting a second distance at a right angle from said rear surface, which second distance is significantly less than said first distance, said projecting and recessed portions at least partially defining a front surface for said layer of foam opposite said rear surface, said open cell polymeric foam from which said layer is formed being a reticulated urethane foam; and means attached to said rear surface adapted for releasably attaching said paint finishing pad tot he support surface of the drive unit;

said layer of foam being sufficiently resiliently compressible to allow the layer of foam to be pressed manually against the painted surface to compress the portions of the layer of foam toward the rear surface of the layer of foam and cause the parts of the front surface of the layer of foam defined by both the projecting portions and the recessed portions to generally conform to the painted surface and press the glazing or compounding material into engagement with the painted surface for efficient removal of imperfections, and subsequently to allow the layer of foam to be manually pressed against the painted surface with a lesser force only sufficient to compress parts of the projecting portions of the layer of foam to complete polishing of the painted surface.

2. A paint finishing pad according to claim 1 wherein said projecting portions of said layer of foam are disposed in a regular rectangular array, said layer of foam includes ridge portions extending between adjacent projecting portions and projecting a third distance at a right angle from said rear surface, which third distance is less than said first distance and greater than said second distance, and said recessed portions define a rectangular array of sockets with each of said sockets being bounded by the ridges between four adjacent projecting portions.

3. A paint finishing pad according to claim 1 wherein the difference between said first distance and said second distance is more than about 0.64 centimeter (0.25 inch).

4. A paint finishing pad according to claim 1 wherein said resiliently compressible layer is of polyester urethane reticulated open cell foam.

5. A paint finishing pad according to claim 1 wherein said resiliently compressible layer is of a polyester urethane reticulated open cell foam which has about 80 pores per linear inch.

6. A paint finishing pad according to claim 1 wherein said resiliently compressible layer is of a 1.75 pound per cubic foot polyester urethane reticulated open cell foam which has about 80 pores per linear inch.

7. A paint finishing pad adapted to be used on a drive assembly including a back up pad having a generally planar support surface and a drive motor for moving the back up pad in a plane parallel to said support surface while using the finishing pad to apply glazing or compounding material to a painted surface and thereby remove imperfections along and polish the painted surface, said finishing pad comprising:

a layer of resiliently compressible open cell polymeric foam having a generally planar rear surface, said layer of foam comprising a plurality of spaced projecting portions projecting a first distance at a right angle from said rear surface, and a plurality of recessed portions between said projecting portions and projecting a second distance at a right angle from said rear surface, which second distance is significantly less than said first distance, said projecting and recessed portions at least partially defining a front surface for said layer of foam opposite said rear surface;

a multiplicity of filaments extending through said layer of foam at generally a right angle to said rear surface, said filaments having ends disposed about flush with at least portions of said front surface; and means attached to said rear surface adapted for releasably attaching said paint finishing pad to the support surface of the drive unit;

said layer of foam being sufficiently resiliently compressible to allow the layer of foam to be pressed manually against the painted surface to compress the portions of the layer of foam toward the rear surface of the layer of foam and cause the parts of the front surface of the layer of foam defined by both the projecting portions and the recessed portions to generally conform to the painted surface and press the glazing or compounding material into engagement with the painted surface for efficient removal of imperfections, and subsequently to allow the layer of foam to be manually pressed against the painted surface with a lesser force only sufficient to compress parts of the projecting portions of the layer of foam to complete polishing of the painted surface.

8. A paint finishing pad according to claim 7 wherein said filaments include filaments of rayon.

9. A paint finishing pad according to claim 7 wherein said filaments are absorbent and have ends disposed about flush with said front surface along said projecting portions and along said recessed portions of said layer of foam.

10. A paint finishing pad according to claim 1 wherein said filaments are absorbent and have ends disposed about flush with said front surface only along said recessed portions of said layer of foam.

11. A paint finishing pad according to claim 7 wherein said resiliently compressible layer is of urethane reticulated open cell foam.

12. A paint finishing pad according to claim 7 wherein said resiliently compressible layer is of a polyester urethane reticulated open cell foam which has about 50 pores per linear inch.

13. A paint finishing pad adapted to be used on a drive assembly including a back up pad having a generally planar support surface and a drive motor for moving the back up pad in a plane parallel to said support surface while using the finishing pad to apply glazing or compounding material to a painted surface and thereby remove imperfections along and polish the painted surface, said finishing pad comprising:

a layer of resiliently compressible open cell polymeric foam having a generally planar rear surface, said layer comprising a plurality of spaced projecting portions projecting a first distance at a right angle from said rear surface, and a plurality of recessed portions between said projecting portions and projecting a second distance at a right angle from said rear surface, which second distance is significantly less than said first distance, said projecting and recessed portions at least partially defining a front surface for said layer of foam opposite said rear surface; and means attached to said rear surface adapted for releasably attaching said paint finishing pad to the support surface of the drive unit comprising an attachment layer including a plurality of loops, and means for attaching said attachment layer to said layer of foam providing passageways between the attachment layer and layer of foam that affords passage of liquid therebetween to facilitates cleaning of the paint finishing pad;

said layer of foam being sufficiently resiliently compressible to allow the layer of foam to be pressed manually against the painted surface to compress the portions of the layer of foam toward the rear surface of the layer of foam and cause the parts of the front surface of the layer of foam defined by both the projecting portions and the recessed portions to generally conform to the painted surface and press the glazing or compounding material into engagement with the painted surface for efficient removal of imperfections, and subsequently to allow the layer of foam to be manually pressed against the painted surface with a lesser force only sufficient to compress parts of the projecting portions of the layer of foam to complete polishing of the painted surface.

14. A paint finishing pad according to claim 13 wherein said resiliently compressible layer is of polyester urethane reticulated open cell foam.

15. A paint finishing pad according to claim 13 wherein said resiliently compressible layer is of a polyester urethane reticulated open cell foam which has about 80 pores per linear inch.

16. A paint finishing ad according to claim 13 wherein said resiliently compressible layer is of a 1.75 pound per cubic foot polyester urethane reticulated open cell foam which has about 80 pores per linear inch.

17. In combination, a drive assembly including a back up pad having a generally planar support surface and a drive motor for moving the back up pad in a plane parallel to said support surface, a paint finishing pad comprising a resiliently compressible layer of open cell polymeric foam having a generally planar rear surface, said layer comprising a plurality of spaced projecting portions projecting a first distance at a right angle from said rear surface, and a plurality of recessed portions between said projecting portions and projecting a second distance at a right angle from said rear surface, which second distance is significantly less than said first distance, said projecting and recessed portions at least partially defining a front surface for said layer of foam opposite said rear surface, said open cell polymeric foam from which said layer is formed being a reticulated urethane foam; and means attaching the rear surface of said layer of foam to the support surface of the drive unit for causing movement of said paint finishing pad with said back up pad;

said layer of foam being sufficiently resiliently flexible to allow the layer of foam to be pressed manually against the painted surface to compress the portions of the layer of foam toward the rear surface of the layer of foam and cause the parts of the front surface of the layer of foam defined by both the projecting portions and the recessed portions to generally conform to the painted surface and press the glazing or compounding material into engagement with the painted surface for efficient removal of imperfections, and subsequently to allow the layer of foam to be manually pressed against the painted surface with a lesser force only sufficient to compress parts of the projecting portions of the layer of foam to complete polishing of the painted surface.

18. A combination according to claim 17 wherein said projecting portions of said layer of foam are disposed in a regular rectangular array, said layer of foam includes ridge portions extending between adjacent projecting portions and projecting a third distance at a right angle from said rear surface, which third distance is less than said first distance and greater than said second distance, and said recessed portions define a rectangular array of sockets with each of said sockets being bounded by the ridges between four adjacent projecting portions.

19. A combination according to claim 17 wherein the difference between said first distance and said second distance is more than about 0.64 centimeter (0.25 inch).

20. A combination according to claim 17 wherein said drive motor rotates said backup pad about a central axis normal to said support surface.

21. A combination according to claim 17 wherein said resiliently compressible layer is of polyester urethane reticulated open cell foam.

22. A combination according to claim 17 wherein said resiliently compressible layer is of a polyester urethane reticulated open cell foam which has about 80 pores per linear inch.

23. A combination according to claim 17 wherein said resiliently compressible layer is of a 1.75 pound per cubic foot polyester urethane reticulated open cell foam which has about 80 pores per linear inch.

24. In combination, a drive assembly including a back up pad having a generally planar support surface and a drive motor for moving the back up pad in a plane parallel to said support surface;

a paint finishing pad comprising a resiliently compressible layer of open cell polymeric foam having a generally planar rear surface, said layer of foam comprising a plurality of spaced projecting portions projecting a first distance at a right angle from said rear surface, and a plurality of recessed portions between said projecting portions and projecting a second distance at a right angle from said rear surface, which second distance is significantly less than said first distance, said projecting and recessed portions at least partially defining a front surface for said layer of foam opposite said rear surface;

a multiplicity of filaments extending through said layer of foam at generally a right angle to said rear surface, said filaments having ends disposed about flush with at least a portion of said front surface; and means attaching the rear surface of said layer of foam to the support surface of the drive unit for causing movement of said paint finishing pad with said back up pad;

said layer of foam being sufficiently resiliently flexible to allow the layer of foam to be pressed manually against the painted surface to compress the portions of the layer of foam toward the rear surface of the layer of foam and cause the parts of the front surface of the layer of foam defined by both the projecting portions and the recessed portions to generally conform to the painted surface and press the glazing or compounding material into engagement with the painted surface for efficient removal of imperfections, and subsequently to allow the layer of foam to be manually pressed against the painted surface with a lesser force only sufficient to compress parts of the projecting portions of the layer of foam to complete polishing of the painted surface.

25. A combination pad according to claim 24 wherein said filaments include filaments of rayon.

26. A combination according to claim 24 wherein said filaments are hydrophilic and have ends disposed about flush with said front surface along said projecting and along said recessed portions.

27. A combination according to claim 24 wherein said filaments are hydrophilic and have ends disposed about flush with said front surface only along said recessed portions of said layer of foam.

28. A combination according to claim 24 wherein said resiliently compressible layer is of urethane reticulated open cell foam.

29. A paint finishing pad according to claim 24 wherein said resiliently compressible layer is of a polyester urethane reticulated open cell foam which has about 50 pores per linear inch.

30. In combination, a drive assembly including a back up pad having a generally planar support surface and a drive motor for moving the back up pad in a plane parallel to said support surface;

a paint finishing pad comprising a resiliently compressible layer of open cell polymeric foam having a generally planar rear surface, said layer comprising a plurality of spaced projecting portions projecting a first distance at a right angle from said rear surface, and a plurality of recessed portions between said projecting portions and projecting a second distance at a right angle from said rear surface, which second distance is significantly less than said first distance, said projecting and recessed portions at least partially defining a front surface for said layer of foam opposite said rear surface; and means attached to said rear surface of said layer of foam releasably attaching said paint finishing pad to the support surface of the drive unit for causing movement of said paint finishing pad with said back up pad comprising an attachment layer including a plurality of loops, and means for attaching said attachment layer to said layer of foam providing passageways between the attachment layer and layer of foam that affords passage of liquid therebetween to facilitate cleaning of the paint finishing pad;

said layer of foam being sufficiently resiliently flexible to allow the layer of foam to be pressed manually against the painted surface to compress the portions of the layer of foam toward the rear surface of the layer of foam and cause the parts of the front surface of the layer of foam defined by both the projecting portions and the recessed portions to generally conform to the painted surface and press the glazing or compounding material into engagement with the painted surface for efficient removal of imperfections, and subsequently to allow the layer of foam to be manually pressed against the painted surface with a lesser force only sufficient to compress parts of the projecting portions of the layer of foam to complete polishing of the painted surface.

31. A paint finishing pad according to claim 30 wherein said resiliently compressible layer is of polyester urethane reticulatd open cell foam.

32. A paint finishing pad according to claim 30 wherein said resiliently compressible layer is of a polyester urethane reticulated open cell foam which has about 80 pores per linear inch.

33. A paint finishing pad according to claim 30 wherein said resiliently compressible layer is of a 1.75 pound per cubic foot polyester urethane reticulated open cell foam which has about 80 pores per linear inch.

34. A paint finishing pad adapted to be used on a drive assembly including a back up pad having a generally planar support surface and a drive motor for moving the back up pad in a plane parallel to said support surface while using the finishing pad to apply glazing or compounding material to a painted surface and thereby remove imperfections along and polish the painted surface, said finishing pad comprising:

a lofty, low density, nonwoven, resiliently compressible layer having a multiplicity of through passageways formed by elongate randomly disposed tough strong resilient fibers adhesively joined to other fibers by a binder at points where the fibers cross and contact each other, said resiliently compressible layer having a generally planar rear surface, and comprising a plurality of spaced projecting portions projecting a first distance at a right angle from said rear surface and a plurality of recessed portions between said projecting portions and projecting a second distance at a right angle from said rear surface, which second distance is significantly less than said first distance, said projecting and recessed portions at least partially defining a front surface for said resiliently compressible layer opposite said rear surface; and means attached to said rear surface adapted for releasably attaching said paint finishing pad to the support surface of the drive unit;

said layer being sufficiently resiliently compressible to allow the layer to be manually pressed against the painted surface to compress the portions of the layer toward the rear surface of the layer and cause the parts of the front surface of the layer defined by both the projecting portions and the recessed portions to generally conform to the painted surface and press the glazing or compounding material into engagement with the painted surface for efficient removal of imperfections, and subsequently to allow the layer to be manually pressed against the painted surface with a lesser force only sufficient to compress parts of the projecting portions of the layer to complete polishing of the painted surface.

35. A paint finishing pad according to claim 34 wherein said projecting portions of said resiliently compressible layer are disposed in a regular rectangular array, said layer includes ridge portions extending between adjacent projecting portions and projecting a third distance at a right angle from said rear surface, which third distance is less than said first distance and greater than said second distance, and said recessed portions define a rectangular array of sockets with each of said sockets being bounded by the ridges between four adjacent projecting portions.

36. A paint finishing pad according to claim 34 wherein the difference between said first distance and said second distance is more than about 0.64 centimeter (0.25 inch).

37. A paint finishing pad adapted to be used on a drive assembly including a back up pad having a generally planar support surface and a drive motor for moving the back up pad in a plane parallel to said support surface while using the finishing pad to apply glazing or compounding material to a painted surface and thereby remove imperfections along and polish the painted surface, said finishing pad comprising:

a lofty, low density, resiliently compressible layer having a multiplicity of through passageways formed by short elongate randomly disposed fibers joined to other fibers at their ends, said resiliently compressible layer having a generally planar rear surface, and comprising a plurality of spaced projecting portions projecting a first distance at a right angle from said rear surface and a plurality of recessed portions between said projecting portions and projecting a second distance at a right angle from said rear surface, which second distance is significantly less than said first distance, said projecting and recessed portions at least partially defining a front surface for said resiliently compressible layer opposite said rear surface;

a multiplicity of filaments extending through said resiliently compressible layer at generally a right angle to said rear surface, said filaments having ends disposed about flush with at least portions of said front surface; and means attached to said rear surface adapted for releasably attaching said paint finishing pad to the support surface of the drive unit;

said layer being sufficiently resiliently compressible to allow the layer to be manually pressed against the painted surface to compress the portions of the layer toward the rear surface of the layer and cause the parts of the front surface of the layer defined by both the projecting portions and the recessed portions to generally conform to the painted surface and press the glazing or compounding material into engagement with the painted surface for efficient removal of imperfections, and subsequently to allow the layer to be manually pressed against the painted surface with a lesser force only sufficient to compress parts of the projecting portions of the layer to complete polishing of the painted surface.

38. A paint finishing pad according to claim 37 wherein said filaments include filaments of rayon.

39. A paint finishing pad according to claim 37 wherein said filaments are hydrophilic and have ends disposed about flush with said front surface along said projecting portions and along said recessed portions of said layer.

40. A paint finishing pad according to claim 37 wherein said filaments are hydrophilic and have ends disposed about flush with said front surface only along said recessed portions of said layer.

41. A paint finishing pad adapted to be used on a drive assembly including a back up pad having a generally planar support surface and a drive motor for moving the back up pad in a plane parallel to said support surface while using the finishing pad to apply glazing or compounding material to a painted surface and thereby remove imperfections along and polish the painted surface, said finishing pad comprising:

a lofty, low density, resiliently compressible layer having a multiplicity of through passageways formed by short elongate randomly disposed fibers joined to other fibers at their ends, said resiliently compressible layer having a generally planar rear surface, and comprising a plurality of spaced projecting portions projecting a first distance at a right angle from said rear surface and a plurality of recessed portions between said projecting portions and projecting a second distance at a right angle from said rear surface, which second distance is significantly less than said first distance, said projecting and recessed portions at least partially defining a front surface for said resiliently compressible layer opposite said rear surface; and means attached to said rear surface adapted for releasably attaching said paint finishing pad to the support surface of the drive unit comprising an attachment layer including a plurality of loops, and means for attaching said attachment layer to said layer providing passageways between the attachment layer and resiliently compressible layer that affords passage of liquid therebetween to facilitates cleaning of the paint finishing pad;

said layer being sufficiently resiliently compressible to allow the layer to be manually pressed against the painted surface to compress the portions of the layer toward the rear surface of the layer and cause the parts of the front surface of the layer defined by both the projecting portions and the recessed portions to generally conform to the painted surface and press the glazing or compounding material into engagement with the painted surface for efficient removal of imperfections, and subsequently to allow the layer to be manually pressed against the painted surface with a lesser force only sufficient to compress parts of the projecting portions of the layer to complete polishing of the painted surface.

42. In combination, a drive assembly including a back up pad having a generally planar support surface and a drive motor for moving the back up pad in a plane parallel to said support surface, a paint finishing pad comprising a lofty, low density, nonwoven, resiliently compressible layer having a multiplicity of through passageways formed by elongate randomly disposed tough strong resilient fibers adhesively joined to other fibers by a binder at points where the fibers cross and contact each other, said resiliently compressible layer having a generally planar rear surface, and comprising a plurality of spaced projecting portions projecting a first distance at a right angle from said rear surface and a plurality of recessed portions between said projecting portions and projecting a second distance at a right angle from said rear surface, which second distance is significantly less than said first distance, said projecting and recessed portions at least partially defining a front surface for said resiliently compressible layer opposite said rear surface; and means attaching the rear surface of said layer to the support surface of the drive unit for causing movement of said paint finishing pad with said back up pad;

said layer being sufficiently resiliently compressible to allow the layer to be manually pressed against the painted surface with a force sufficient to compress the portions of said layer toward said rear surface and cause the parts of the front surface of the layer defined by both the projecting portions and the recessed portions of the layer to generally conform to the painted surface and press the glazing or compounding material into engagement with the painted surface for efficient removal of imperfections, and subsequently to allow the layer to be manually pressed against the painted surface with a lesser force only sufficient to compress parts of the projecting portions of the layer to complete polishing of the painted surface.

43. A combination according to claim 42 wherein said projecting portions of said layer are disposed in a regular rectangular array, said layer includes ridge portions extending between adjacent projecting portions and projecting a third distance at a right angle from said rear surface, which third distance is less than said first distance and greater than said second distance, and said recessed portions define a rectangular array of sockets with each of said sockets being bounded by the ridges between four adjacent projecting portions.

44. A combination according to claim 42 wherein the difference between said first distance and said second distance is more than about 0.64 centimeter (0.25 inch).

45. A combination according to claim 42 wherein said drive motor rotates said back up pad about a central axis normal to said support surface.

46. In combination, a drive assembly including a back up pad having a generally planar support surface and a drive motor for moving the back up pad in a plane parallel to said support surface;

a paint finishing pad comprising a lofty, low density, resiliently compressible layer having a multiplicity of through passageways formed by short elongate randomly disposed fibers joined to other fibers at their ends, said resiliently compressible layer having a generally planar rear surface, and comprising a plurality of spaced projecting portions projecting a first distance at a right angle from said rear surface and a plurality of recessed portions between said projecting portions and projecting a second distance at a right angle from said rear surface, which second distance is significantly less than said first distance, said projecting and recessed portions at least partially defining a front surface for said resiliently compressible layer opposite said rear surface;

a multiplicity of filaments extending through said resiliently compressible layer at generally a right angle to said rear surface, said filaments having ends disposed about flush with at least a portion of said front surface; and means attaching the rear surface of said layer to the support surface of the drive unit for causing movement of said paint finishing pad with said back up pad;

said layer being sufficiently resiliently compressible to allow the layer to be manually pressed against the painted surface with a force sufficient to compress the portions of said layer toward said rear surface and cause the parts of the front surface of the layer defined by both the projecting portions and the recessed portions of the layer to generally conform to the painted surface and press the glazing or compounding material into engagement with the painted surface for efficient removal of imperfections, and subsequently to allow the layer to be manually pressed against the painted surface with a lesser force only sufficient to compress parts of the projecting portions of the layer to complete polishing of the painted surface.

47. A combination according to claim 46 wherein said filaments include filaments of rayon.

48. A combination according to claim 46 wherein said filaments are hydrophilic and have ends disposed about flush with said front surface along said projecting and along said recessed portions.

49. A combination according to claim 46 wherein said filaments are hydrophilic and have ends disposed about flush with said front surface only along said recessed portions of said layer.

50. In combination, a drive assembly including a back up pad having a generally planar support surface and a drive motor for moving the back up pad in a plane parallel to said support surface, a paint finishing pad comprising a lofty, low density, resiliently compressible layer having a multiplicity of through passageways formed by short elongate randomly disposed fibers joined to other fibers at their ends, said resiliently compressible layer having a generally planar rear surface, and comprising a plurality of spaced projecting portions projecting a first distance at a right angle from said rear surface and a plurality of recessed portions between said projecting portions and projecting a second distance at a right angle from said rear surface, which second distance is significantly less than said first distance, said projecting and recessed portions at least partially defining a front surface for said resiliently compressible layer opposite said rear surface; and means attached to said rear surface releasably attaching said paint finishing pad to the support surface of the drive unit for causing movement of said paint finishing pad with said back up pad comprising an attachment layer including a plurality of loops, and means for attaching said attachment layer to said resiliently compressible layer providing passageways between the attachment layer and said resiliently compressible layer that affords passage of liquid therebetween to facilitates cleaning of the paint finishing pad;

said layer being sufficiently resiliently compressible to allow the layer to be manually pressed against the painted surface with a force sufficient to compress the portions of said layer toward said rear surface and cause the parts of the front surface of the layer defined by both the projecting portions and the recessed portions of the layer to generally conform to the painted surface and press the glazing or compounding material into engagement with the painted surface for efficient removal of imperfections, and subsequently to allow the layer to be manually pressed against the painted surface with a lesser force only sufficient to compress parts of the projecting portions of the layer to complete polishing of the painted surface.

* * * * *

US005007128A

REEXAMINATION CERTIFICATE (2144th)

United States Patent [19]

[11] B1 5,007,128

Englund et al.

[45] Certificate Issued * Dec. 7, 1993

[54] COMPOUNDING, GLAZING OR POLISHING PAD

[75] Inventors: Richard L. Englund; Thomas W. Schwartz, both of St. Paul, Minn.

[73] Assignee: Minnesota Mining and Manufacturing Company, St. Paul, Minn.

Reexamination Request:
No. 90/002,887, Nov. 10, 1992

Reexamination Certificate for:

| | |
|---|---|
| Patent No.: | 5,007,128 |
| Issued: | Apr. 16, 1991 |
| Appl. No.: | 458,411 |
| Filed: | Dec. 28, 1989 |

[ * ] Notice: The portion of the term of this patent subsequent to Oct. 16, 2007 has been disclaimed.

Related U.S. Application Data

[63] Continuation of Ser. No. 298,508, Jan. 18, 1989, Pat. No. 4,962,562.

[51] Int. Cl.[5] ..... B24B 29/00

[52] U.S. Cl. ..... 15/230.16; 15/230; 15/230.18; 15/244.4; 51/394; 51/398; 51/401

[58] Field of Search ..... 15/230, 230.16, 230.18, 15/244.4; 51/398, 394, 401

[56] References Cited

U.S. PATENT DOCUMENTS

| | | | |
|---|---|---|---|
| 1,953,983 | 4/1934 | Benner | 51/280 |
| 3,346,904 | 2/1964 | Armstrong | 15/230 |
| 3,418,675 | 10/1967 | Meguiar et al. | 15/230 |
| 4,609,581 | 9/1986 | Ott | 428/100 |

FOREIGN PATENT DOCUMENTS

| | | | |
|---|---|---|---|
| 56-126581 | 10/1981 | Japan . | |
| 58-4361 | 1/1983 | Japan . | |
| 990142 | 4/1965 | United Kingdom | 15/230 |

*Primary Examiner*—Edward L. Roberts

[57] ABSTRACT

A paint finishing pad adapted to be used on a drive assembly including a back up pad and a drive motor for rotating the back up pad. The paint finishing pad includes a layer of open cell polymeric foam having a front surface defined by a plurality of spaced projecting portions of the layer of foam, and loops projecting from a rear surface of the layer of foam for releasably attaching the paint finishing pad to a support surface on the back up pad.

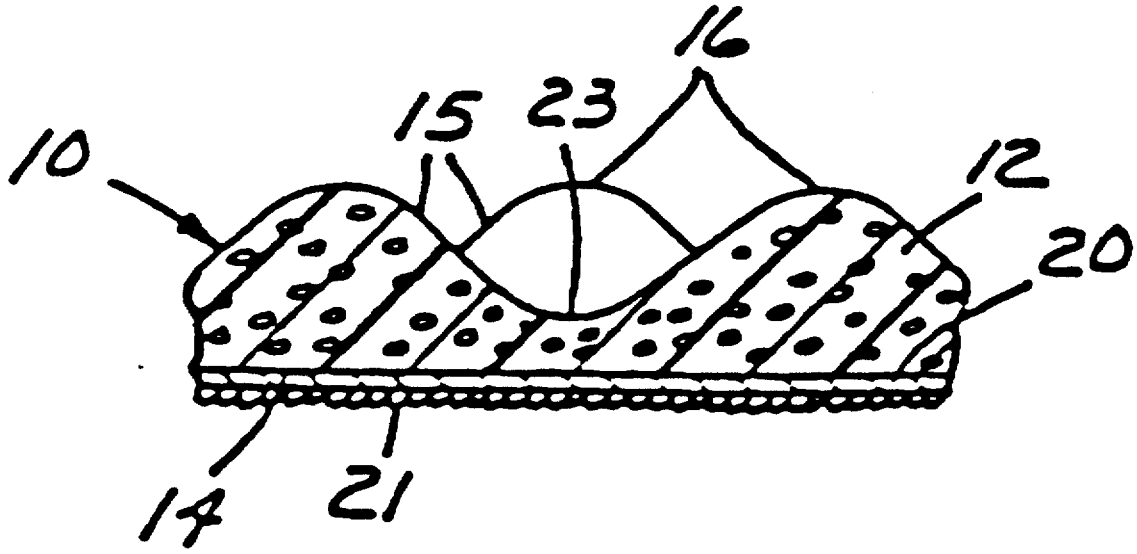

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–50 is confirmed.

* * * * *